United States Patent [19]

Batiste

[11] Patent Number: 4,726,077

[45] Date of Patent: Feb. 23, 1988

[54] POSTMAN'S BELT

[76] Inventor: Elie P. Batiste, 1120 Sharon, #29, Baton Rouge, La. 70714

[21] Appl. No.: 670,945

[22] Filed: Nov. 13, 1984

[51] Int. Cl.[4] ..... A41F 9/00

[52] U.S. Cl. ..... 2/321; 2/338

[58] Field of Search ..... 2/51, 338, 321

[56] References Cited

U.S. PATENT DOCUMENTS 3,470,570 10/1969 Christiansen ..... 2/238

4,472,839 9/1984 Johansen ..... 2/338

*Primary Examiner*—Werner H. Schroeder

*Attorney, Agent, or Firm*—William D. Kiesel; Robert C. Tucker; Timothy J. Monahan

[57] ABSTRACT

A postman's belt is provided, comprising at least one adjustable circumferential band having an enlarged section attached thereto such that the enlarged section is positionable on the side of the wearer. A storage pouch may be added to the belt.

2 Claims, 1 Drawing Figure

POSTMAN'S BELT

BACKGROUND OF THE INVENTION

1. Field of the Invention

This invention relates generally to belts and, more particularly, to belts which are worn for protective reasons.

2. Prior Art

Postmen who carry mail from house to house generally carry several parcels of mail at one time. Usually, a postman carries such parcels under his arm, resting them against his side and, consequently, against his uniform. A postman's mailbag would also rest in the same area. One problem which has developed as a result of this situation is that dyes and ink from the various parcels tend to destroy the fabric of the uniform. Compounding this problem is simple wear caused by carrying mail in the above described manner.

The result of these problems is costly replacement of clothing which, except for the damage caused by carrying mail, is otherwise suitable for wear. No device is known to be commercially available which would eliminate these problems.

SUMMARY OF THE INVENTION

Therefore it is an object of this invention to provide a device which will protect the clothing of a postman from damage caused by carrying mail.

It is another object of this invention to provide such a device which is removable and comfortable to wear.

Still further objects and advantages will become apparent from the ensuing descriptions of the invention.

Accordingly, a postman's belt is provided, comprising at least one adjustable circumferential band having an enlarged section attached thereto such that the enlarged section is positionable on the side of the wearer. A storage pouch may be added to the belt.

DESCRIPTION OF PREFERRED EMBODIMENTS OF THE INVENTION

Figure 1:
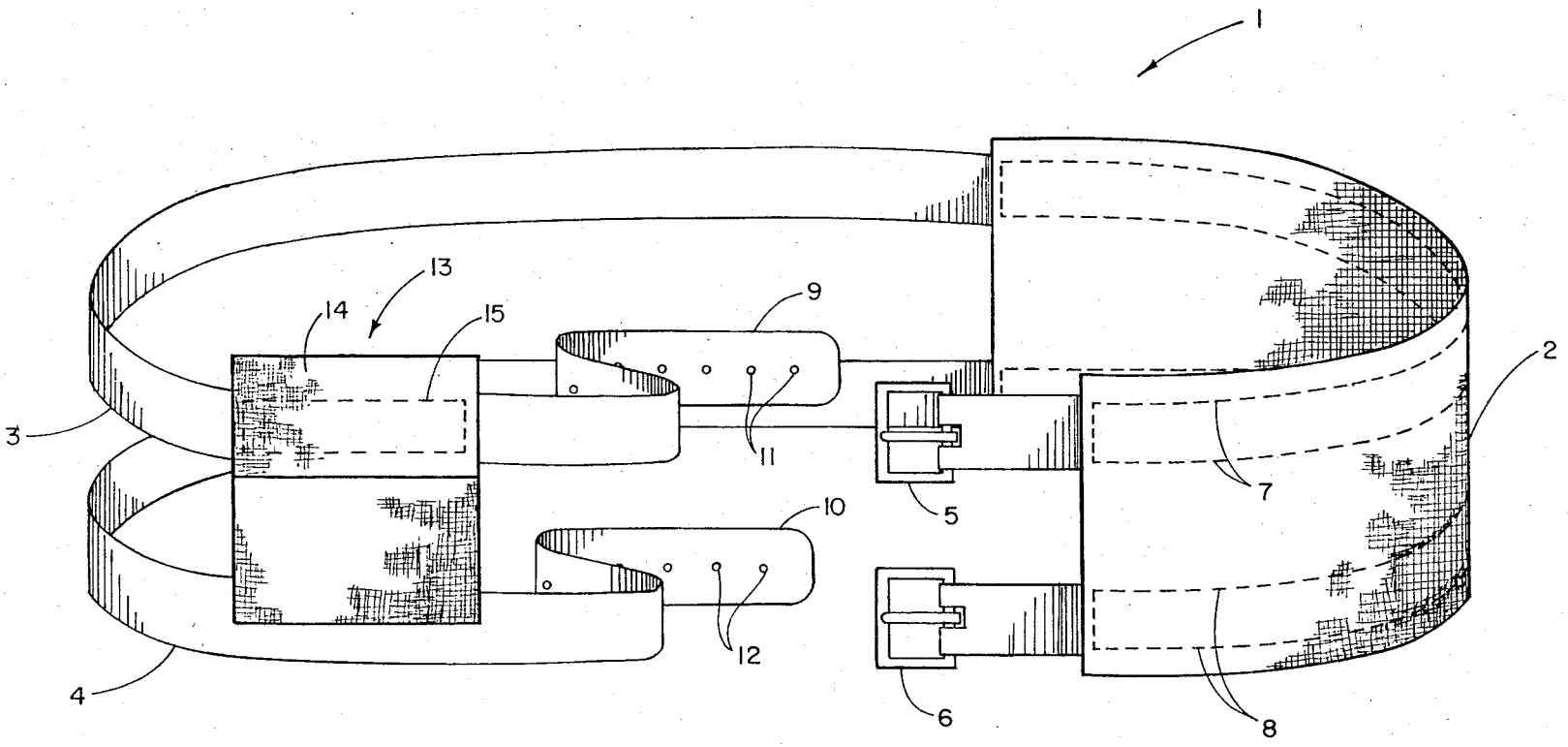
FIG. 1 is a three dimensional view of a preferred embodiment of the invention.

As shown in FIG. 1, a preferred embodiment of the invention 1 generally comprises a circumferential upper band 3 and a circumferential lower band 4. The upper and lower bands 3 and 4 have buckles 5 and 6 into which ends 9 and 10 are insertable, respectively. Adjustment holes 11 and 12 are provide for varying sizes. Other known means of adjustment may be utilized as well.

An enlarged section 2 is provided and located at a point on the belt 1 which corresponds to the side of the wearer. Of course, belts 1 can be made to accommodate a postman carrying mail on either his left or his right side. It is preferred that the enlarged section 2 be secured to upper and lower bands 3 and 4 by upper and lower stitching 7 and 8 or other suitable means. By providing upper and lower bands 3 and 4 as well as stitching 7 and 8, the enlarged section 2 may be secured in place, thus limiting its tendency to move away from the clothing area to be protected. Of course, the belt could be made utilizing a single circumferential band if desired.

A utility pouch 13 is shown attached by stitches 15 to upper band 3. Flap 14 secures items in pouch 13. The pouch 13 allows the postman to store necessary accessories (e.g. pens, stamps, etc.) outside of his clothing, reducing the likelihood of having to remove the belt during times of use.

It is preferred that the belt components be made of lightweight material to prevent fatigue during long hours of wear.

As can be seen, the postman's belt provides a shield against garment damage. It is easily worn over clothing, and the utility pouch 13 allows the postman to keep necessary items of his trade handy. Other embodiments and improvements will occur to those skilled in the art and are intended to be included within the scope and spirit of the following claims.

I claim:

1. A postman's belt, comprising an upper adjustable circumferential band, a lower adjustable circumferential band, and an enlarged section fixedly attached to said upper and lower bands so as to be positioned on one side of the wearer of said belt when said belt is in place.

2. A postman's belt according to claim 1, further comprising a utility pouch attached to at least one of said bands.

* * * * *